US009016977B2

(12) United States Patent
Rosier

(10) Patent No.: US 9,016,977 B2
(45) Date of Patent: Apr. 28, 2015

(54) SURFACE COVERING FOR ENABLING A SURFACE TO BE CROSSED, IN PARTICULAR BY VEHICLES

(75) Inventor: Reza Rosier, Dottignies (BE)

(73) Assignee: Musthane, Willems (FR)

( * ) Notice: Subject to any disclaimer, the term of this patent is extended or adjusted under 35 U.S.C. 154(b) by 0 days.

(21) Appl. No.: 13/407,330

(22) Filed: Feb. 28, 2012

(65) Prior Publication Data

US 2012/0321382 A1 Dec. 20, 2012

(30) Foreign Application Priority Data

Jun. 17, 2011 (FR) ..... 11 55299

(51) Int. Cl.
*E01C 5/06* (2006.01)
*E01B 23/00* (2006.01)
*E01C 9/08* (2006.01)

(52) U.S. Cl.
CPC ..... *E01C 9/086* (2013.01)

(58) Field of Classification Search
USPC ..... 404/29, 31, 33–36, 40, 41; 238/14
See application file for complete search history.

(56) References Cited

U.S. PATENT DOCUMENTS

| | | | | |
|---|---|---|---|---|
| 1,004,861 | A * | 10/1911 | Ek | 238/14 |
| 1,617,271 | A * | 2/1927 | Penfield | 238/14 |
| 3,607,592 | A * | 9/1971 | Jenkins | 428/111 |
| 3,999,879 | A | 12/1976 | Stachiw et al. | |
| 4,488,833 | A | 12/1984 | Perry et al. | |
| 4,795,093 | A * | 1/1989 | Kozelnicky | 238/14 |
| 4,801,483 | A * | 1/1989 | Beckerman et al. | 428/71 |
| 4,896,993 | A * | 1/1990 | Bohnhoff | 404/33 |
| 5,139,845 | A * | 8/1992 | Beckerman et al. | 428/117 |
| 6,696,122 | B1 * | 2/2004 | Deschamps | 428/36.1 |
| 7,427,172 | B2 * | 9/2008 | Lukasik | 404/36 |
| 7,634,876 | B2 * | 12/2009 | Moller, Jr. | 52/177 |
| 7,651,118 | B1 * | 1/2010 | Veiga | 280/728.1 |
| 2005/0191126 | A1 * | 9/2005 | Amelung, Sr. | 404/36 |
| 2006/0222804 | A1 | 10/2006 | Banting | |
| 2011/0290146 | A1 * | 12/2011 | Maerten | 105/18 |

FOREIGN PATENT DOCUMENTS

| | | | |
|---|---|---|---|
| CN | 201169734 | Y | 12/2008 |
| EP | 0617160 | A1 | 9/1994 |
| EP | 617160 | A1 * | 9/1994 |
| FR | 2776308 | A1 | 9/1999 |
| FR | 2 866 908 | A1 | 9/2005 |
| GB | 1 498 962 | A | 1/1978 |

OTHER PUBLICATIONS

European Patent Office, International Search Report in PCT/FR2012/051137, dated Sep. 10, 2012, 5 pages.

* cited by examiner

*Primary Examiner* — Abigail A Risic
(74) *Attorney, Agent, or Firm* — Kenyon & Kenyon LLP

(57) ABSTRACT

The present invention provides a surface covering for enabling a surface, e.g. of the uneven, muddy, marshy, or sandy ground type, to be crossed by a vehicle, said surface covering including a double-ply textile core having two covered faces, each covered with at least one polymer layer, and a plurality of through tubular pockets extending substantially transversely through the thickness of the core between the two layers, and enabling respective stiffener bars to be inserted into each tubular pocket so as to make it possible, in particular, to increase the drivability and the load-bearing capacity of the surface when the surface covering is positioned on said surface.

23 Claims, 3 Drawing Sheets

SURFACE COVERING FOR ENABLING A SURFACE TO BE CROSSED, IN PARTICULAR BY VEHICLES

CROSS REFERENCE TO RELATED APPLICATION

This application claims priority to French application No. 11/55299, filed Jun. 17, 2011, which is incorporated herein by reference.

TECHNICAL FIELD

The present invention relates to the field of surface coverings. The present invention relates more particularly to surface coverings for enabling an uneven surface, such as, for example, uneven, muddy, marshy, or sandy ground, to be crossed, in particular by one or more vehicles.

The present invention has advantageous applications in the field of crossing means such as mats or surface coverings configured to facilitate crossing by a vehicle.

The present invention is applicable particularly advantageously to the military and humanitarian fields, by enabling motor vehicles to advance when such vehicles need to pass over natural barriers such as, for example, uneven ground, muddy ground, marshy ground, or indeed sandy ground.

The present invention is also applicable particularly advantageously to airfields by facilitating taxiing of an aircraft that has become bogged down, or by enabling a helicopter to land on terrain that is uneven or soft, or that generates dust, where particles of dust might damage the blades of the helicopter.

In the meaning of the present invention, the term "surface" is to be understood throughout the present description as being any type of surface (ground, road, track, terrain, field, beach, etc.) that can be crossed, e.g. on foot or in a vehicle, optionally a motor vehicle (automobile, 4×4, quad bike, heavy goods vehicle, military vehicle, motorbike, airplane, helicopter, etc.).

STATE OF THE ART

It is known, in particular during military operations or during situations of the 4×4 adventure raid type, that motor vehicles need to pass over natural obstacles, such as, for example, marshland, slippery ground, or uneven ground having roughness of the type comprising rocks, stones, etc.

Such uneven surfaces are sometimes difficult, or indeed impossible, to pass over.

In order to facilitate passing over such obstacles, certain types of vehicles have, at their front and/or rear ends, means of the on-board winch type fastened to the front chassis and/or to the rear chassis.

However, it can be understood that that type of solution is adapted to vehicles crossing the obstacle only one at a time.

In addition, the use of a winch for passing over an obstacle is often a hazardous and risky operation.

In order to enable one or more vehicles to cross the obstacle, more appropriate means are known from the state of the art that consist of a surface covering or mat configured to improve the load-bearing capacity of the surface to be passed over when said covering covers said surface.

Document FR 2 866 908 offers a pertinent solution to this type of problem by proposing a temporary surface covering for enabling vehicles to travel over it. In that document, the surface covering is made up of parallel slats that are hinged together via interposed coupling means secured to the slats.

Also for addressing the same problem, Document U.S. Pat. No. 4,488,833 provides equivalent teaching by proposing a surface covering for enabling military-type vehicles to cross a surface.

The technical contribution made by the teaching of those documents relates essentially to the mutual deployment of the slats for forming the covering.

Although the solutions proposed in those documents offer advantages in terms of strength and of storage, they are lengthy and difficult to deploy, in particular when the people deploying them need to act under extreme conditions.

The Applicant observes, in particular, that the component structural elements of that type of solution involve large overall volumes and large weights.

The Applicant also observes that, generally, it is necessary to use specific tooling for installing such coverings, and for joining the slats together.

Other solutions exist that make it possible to solve the above-mentioned problems at least in part. Such solutions can be found, in particular, in Documents GB 1 498 962 or U.S. Pat. No. 3,999,879.

Those documents propose to use inflatable roll-out mats enabling vehicles to cross uneven surfaces.

However, the Applicant observes that that type of solution is not strong: for obvious reasons of weight and buoyancy, it can be difficult to drive military vehicles of the tank type over such inflatable mats.

The Applicant also observes that such "inflatable" solutions require prior inflation, which is a lengthy and constraining task.

Finally, the Applicant observes that, predictably, in the event of a puncture, driving vehicles across is almost impossible; such a puncture can cause dangerous accidents.

In any event, the solutions proposed in the various documents of the state of the art are not fully satisfactory, in particular in terms of strength, cost, and deployment. The Applicant is of the opinion, in particular, that the various solutions proposed in all of the above-mentioned documents are not fully satisfactory in terms of speed of deployment, or in terms of storage, of performance, and of strength.

OBJECTS AND SUMMARY OF THE PRESENT INVENTION

An object of the present invention is to provide a simple and effective solution to the above-mentioned problems, and an object of the present invention is also to solve problems related to production costs and to manufacturing.

One of the technical problems to be solved by the present invention thus consists in proposing a solution enabling vehicles, e.g. of the motor vehicle type, to cross a surface, e.g. of the uneven, muddy, marshy or sandy ground type.

To this end, the present invention provides a surface covering or mat, for enabling a surface, e.g. of the uneven, muddy, marshy, or sandy ground type, to be crossed, in particular by at least one vehicle.

Naturally, it can be understood that the surface covering of the present invention also enables any other type of article or any individual to cross any surface, including surfaces other than the surfaces listed above. It can also be understood that the term "cross" also includes landing or any other type of movement of any type of vehicle.

Advantageously, the surface covering of the present invention includes a double-ply textile core having:

two covered faces, each covered with at least one polymer layer; and a plurality of through tubular pockets extending substantially transversely through the thickness of the core between the two layers.

Thus, by means of the presence of such tubular pockets, it is possible to insert respective stiffener bars into each tubular pocket so as to make it possible, in particular, to increase the drivability and the load-bearing capacity of the surface when the surface covering is positioned on said surface.

The term "double-ply textile core" is used to mean any textile core having at least two textile layers, without the two layers necessarily being bonded to each other, e.g. during a weaving operation. It can thus be understood that such a double-ply textile core has four distinct faces.

Advantageously, each of the four faces of the double-ply textile core is covered by at least one polymer layer.

The polymer layer may, in non-limiting manner, be fastened to each of the faces of the double-ply textile core by using a bonding method (e.g. coating by extrusion, by calendering, by vulcanization, etc.).

With such a configuration, and thus with such an increase in drivability and in load-bearing capacity, it is possible for vehicles, and even for heavy vehicles of the tank type or of the aircraft type to pass over natural barriers such as uneven surfaces like those described above.

Advantageously, the surface covering has a plurality of polymer layers.

Advantageously, each tubular pocket has a diameter substantially lying in the range 10 millimeters (mm) to 40 mm, and preferably substantially equal to 25 mm.

The tubular pockets of the covering may also have diameters that differ from one pocket to another, without going beyond the ambit of the present invention.

Advantageously, each polymer layer has thickness lying substantially in the range 0.5 mm to 3 mm; this thickness is preferably substantially equal to 1.5 mm. A different thickness may be deposited on each of the covered faces without going beyond the ambit of the present invention.

With such a range of values for the thickness of the polymer layer, the Applicant has observed, in particular, the following results: good resistance to abrasion when using the surface covering on ground having sharp objects (stones etc.), and good resistance to ultraviolet radiation, to hydrocarbons, to ozone, and to other external attacks.

Advantageously, the polymer is an elastomer.

Using elastomer for coating the faces of the covering imparts breaking elongation or grip properties to it that are analogous to those of natural rubber.

The elastomer may, in non-limiting manner, be fastened to each of the faces of the covering by using a bonding method (e.g. coating by extrusion, by calendering, by vulcanization, etc.).

In a variant, provision is made for polyvinylchloride (PVC) to be present on the faces of the covering.

In addition, in a variant, a covering is designed that has its faces covered with mutually different materials having advantageous breaking elongation and grip properties.

Advantageously, the polymer used for each of the layers has Shore A hardness lying substantially in the range 25 to 90; preferably this Shore A hardness is substantially equal to 80.

Such hardness enables the covering to offer good grip between the tires of the vehicle and the surface covering.

Advantageously, each layer has different hardness, in order for the surface covering to satisfy requirements as well as possible both in terms of vehicle grip and also in terms of resistance to friction on the surface.

Advantageously, each tubular pocket is obtained while the two layers are being vulcanized together. Naturally, it can be understood that other equivalent methods may make it possible to obtain such tubular pockets while the covering is being manufactured.

Advantageously, the outside face of at least one of the two layers, and preferably of both of said layers, has a tread formed directly in the polymer for the purpose of improving the drivability of the covering. The Applicant has observed that the vulcanization method makes it easy to mark any type of non-slip tread for improving vehicle grip.

Advantageously, the outside face of at least one of the two layers, and preferably of both of said layers, has a centering strip that is designed to enable the central axis of the covering to be seen and to make it easier to drive the vehicle over the surface covering.

Advantageously, the successive tubular pockets are spaced apart by a separation distance substantially lying in the range 80 mm to 300 mm; preferably, this separation distance is substantially equal to 150 mm.

Preferably, the separation distance between the tubular pockets varies over the various portions of the covering.

This separation distance enables the covering firstly to maintain good longitudinal flexibility so that the covering can be rolled out, and secondly to have good stiffness in the transverse direction with the bars being inserted in the pockets.

Advantageously, in a preferred embodiment, each stiffener bar is made of a composite material. Naturally, it can be understood that any other type of material that is equivalent in terms of mechanical properties may be used to replace the composite material used herein for the stiffener bars.

The bending modulus of the stiffener bars lies substantially in the range 40 gigapascals (GPa) to 250 GPa; preferably this bending modulus is substantially equal to 110 GPa.

This bending modulus enables the covering to offer very good transverse stiffness and thus a good load-bearing capacity on soft ground, and indeed to be usable on ground having holes.

Advantageously, the tubular pockets are substantially parallel to one another.

Advantageously, the double-ply textile core is embedded in the polymer during the vulcanization in order to reinforce the covering. Preferably, the double-ply textile core has tensile strength substantially lying in the range 300 decanewtons per centimeter (daN/cm) to 2000 daN/cm, and preferably substantially equal to 1200 daN/cm.

This tensile strength makes it possible to impart high tensile, tear, and puncture strength to the covering.

Advantageously, the surface covering includes anchor means configured to enable the surface covering to be anchored by means of a rigid fastening element such as, for example, a metal peg driven into the surface. Such anchor means thus enable the surface covering to be made stable while said covering is in use, in particular, on a soft surface, such as marshy ground.

Advantageously, in, a preferred variant embodiment, the anchor means consist of at least one metal insert positioned at the periphery of the surface covering.

Advantageously, the surface covering includes graspable means, such as, for example, handles, positioned around the periphery of the surface covering.

Correspondingly, the present invention also provides the use of a surface covering as defined above for enabling at least one vehicle of the motor vehicle type to cross a surface, e.g. of the uneven, muddy, marshy, or sandy ground type.

Thus, by means of its various functional aspects and of its advantageous characteristics, the present invention mitigates the various drawbacks observed in the state of the art by making it easy to store a surface covering and to deploy it for enabling one or more individuals or one or more motor vehicles to cross an uneven surface, e.g. of the uneven, muddy, or marshy ground type.

BRIEF DESCRIPTION OF THE FIGURES

Other characteristics and advantages of the present invention appear from the following description given with reference to accompanying FIGS. 1*a*-1*b* to accompanying FIGS. 4*a*-4*c* that show an embodiment that is in no way limiting and in which.

DETAILED DESCRIPTION OF AN EMBODIMENT OF THE PRESENT INVENTION

A particular embodiment of a surface covering of the present invention is described below with reference to FIGS. 1*a* to 4*c*.

One of the objectives of the present invention is to make it possible to manufacture a surface covering combining, in particular, both the flexibility and the stiffness characteristics that are needed for making it easier for a vehicle (or for an individual) to cross a natural obstacle as described above.

Figure 2A:
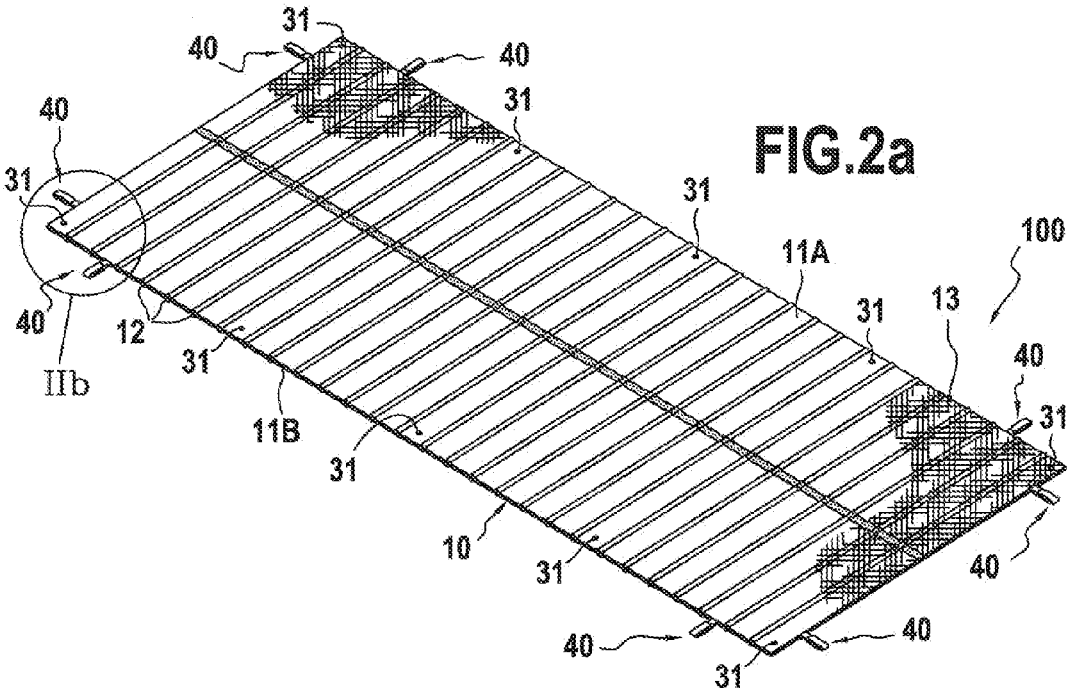
FIGS. 2*a* and 2*b* are diagrammatic perspective views showing a surface covering as in FIGS. 1*a* and 1*b;*

To this end, the present invention provides a specific surface covering 100 shown in a plan view in Figure is and in a perspective view in FIG. 2*a*.

Figure 3:
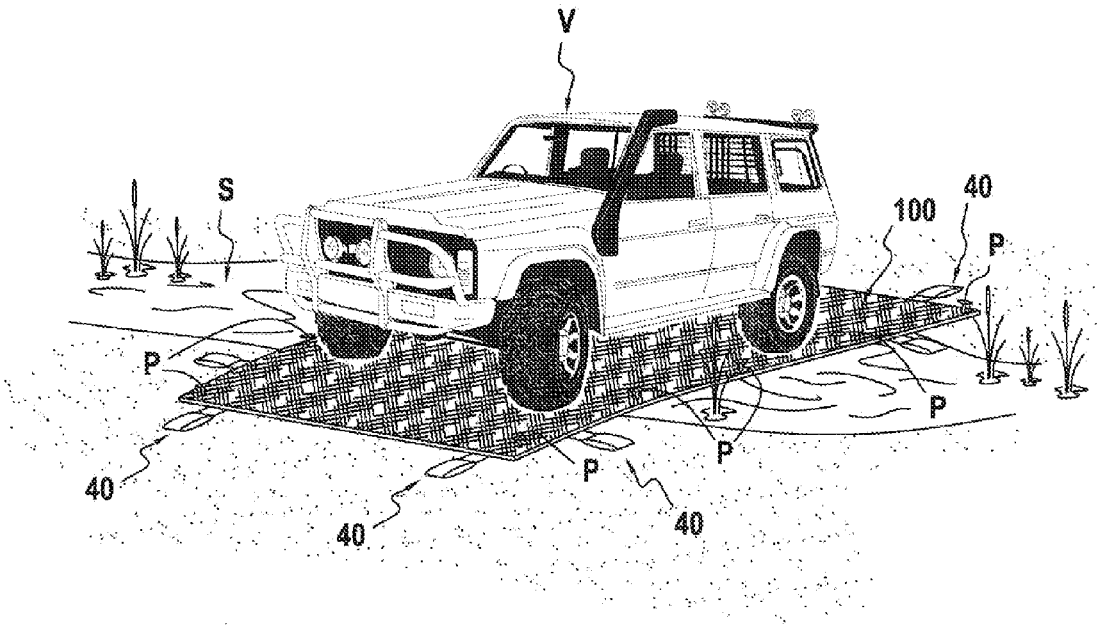
FIG. 3 is a diagrammatic view of use of the particular embodiment of a surface covering shown in FIGS. 1*a* and 1*b*.

In the example described herein, and as shown in FIG. 3, the surface covering 100 of the present invention enables a vehicle V of the 4×4 type to cross a surface S of the marshy ground type.

It can be understood that this embodiment is in no way limiting. The surface covering 100 of the present invention is suitable for any other type of equivalent vehicle: tanks, heavy goods vehicles, humanitarian convoys, all-terrain vehicles, airplanes, helicopters, etc.; and for any other type of uneven (or smooth) surface: ground that is marshy, muddy, stony, etc.

Figure 1A:
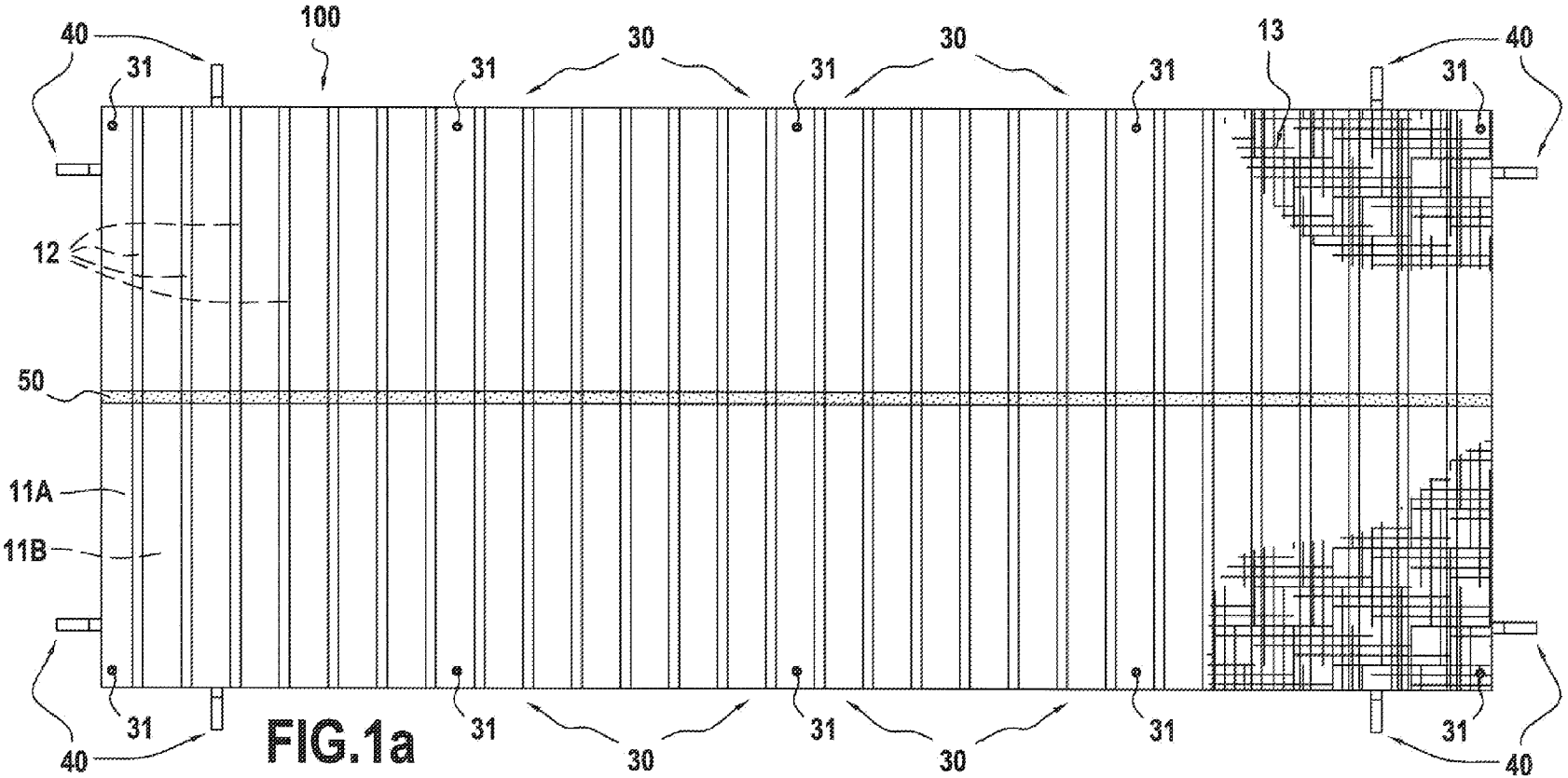
FIGS. 1*a* and 1*b* are diagrammatic views, respectively in plan and in section, showing a particular embodiment of a surface covering of the present invention.
Figure 1B:
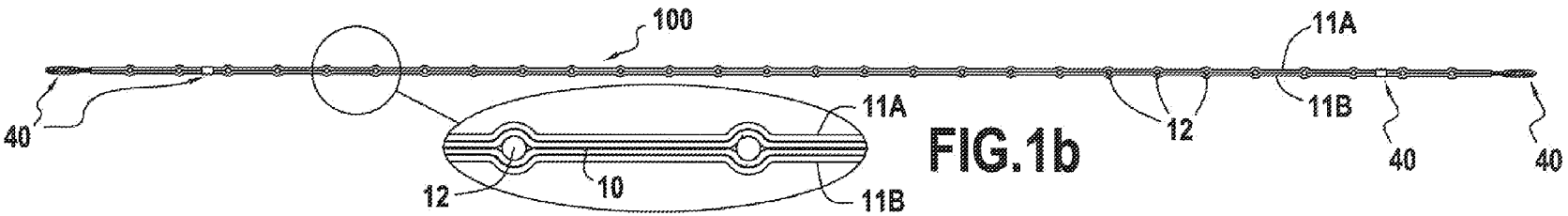

In the example described herein, and as shown in particular in FIG. 1*b*, the surface covering 100 of the present invention comprises a double-ply textile core 10 advantageously having tensile strength equal to 1200 daN/cm.

The term "double-ply textile core" is used to mean any textile core having at least two textile layers, without the two layers necessarily being bonded to each other, e.g. during a weaving operation. Such a core thus has four distinct faces: two faces disposed inside the textile core, and two faces disposed facing outwards.

Any type of textile satisfying these properties may be considered in the context of the present invention.

In the example described herein, the textile core 10 of the present invention has each of two of its faces covered with a layer 11A, 11B of an elastomer material having Shore A hardness substantially equal to 80.

In the example shown with reference to FIG. 1*b*, each of the two outside faces of the textile core is covered with a layer made of an elastomer material. Without going beyond the ambit of the present invention, it is also possible to design a textile core having each of its four faces covered with a layer of an elastomer material, or of any other material having breaking elongation or grip properties analogous to those of natural rubber, it being possible, in non-limiting manner, for such a material to be a polymer (such as, for example, PVC, nitrile butadiene rubber (NBR), styrene butadiene rubber (SBR), etc.).

The Applicant believes that there does not currently exist any surface covering including such a material.

By way of an improvement, it is also possible to make provision to superpose a plurality of layers of elastomer or of any other type of material satisfying the strength and grip requirements needed for the present invention.

Figure 2B:
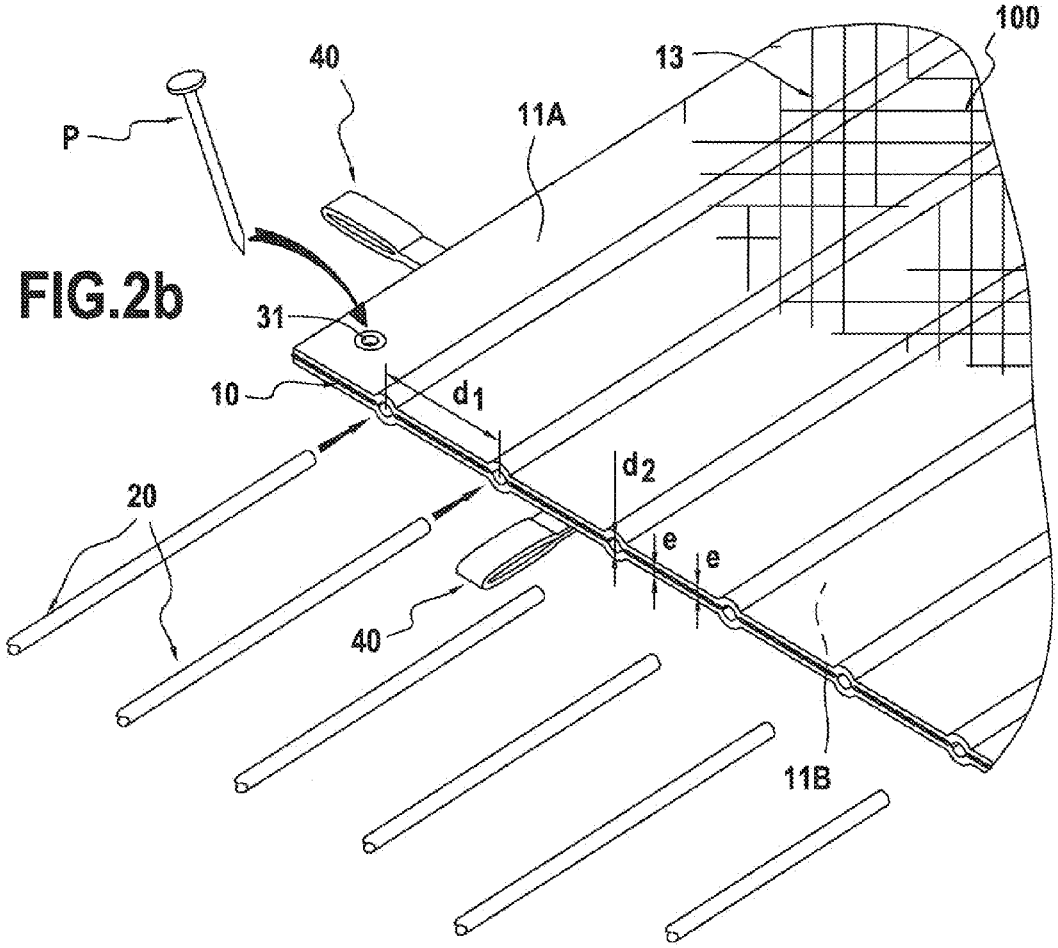

In the example described herein, and as shown in FIG. 1*b* and in FIG. 2*b*, each layer 11A and 11B of elastomer has a thickness e substantially equal to 1.5 mm. Surprisingly, this relatively thin thickness e makes it possible to obtain a very good strength coefficient for the covering 100 in its general structure. This is made possible, in particular, by adding stiffener bars 20 that are described below in the present detailed description.

In the embodiment described herein, the textile core 10 is embedded between two layers of elastomer 11A and 11B, the embedding preferably taking place while the two layers are being vulcanized together. The textile core 10 then reinforces the general structure of the covering 100.

In the example described herein, and shown, in particular, in FIGS. 1*b* and 2*b*, the textile core 10 of the present invention has a plurality of through tubular pockets 12 that are mutually parallel, each pocket 12 extending substantially transversely through the thickness of the core 10 between the two layers 11A and 11B.

In the example described herein, the diameter d2 of each pocket 12 is substantially equal to a value lying approximately in the range 1 mm to 5 mm.

In another variant, a surface covering is designed in which the diameters of the pockets are not identical, so as to impart properties to the surface covering that vary over its various portions.

Preferably, each tubular pocket 12 is obtained while the two layers 11A and 11B are being vulcanized together. Naturally, it can be understood that other equivalent manufacturing methods of obtaining pockets 12 may be considered in the context of the present invention.

In the embodiment described herein, the successive tubular pockets 12 are spaced apart from one another by a separation distance d1 substantially equal to 150 mm.

This distance d1 guarantees good flexibility since it enables the covering 100 to be rolled up, and it also guarantees good strength.

As shown in FIG. 2*b*, the pockets 12 are designed to enable a respective stiffener bar 20 made of a composite material to be inserted into each of them, thereby making it possible to increase the drivability and the load-bearing capacity of the surface S when the surface covering 100 is positioned on the surface S.

In the example described herein, the composite material has a bending modulus substantially equal to 110 GPa.

Figure 4A:
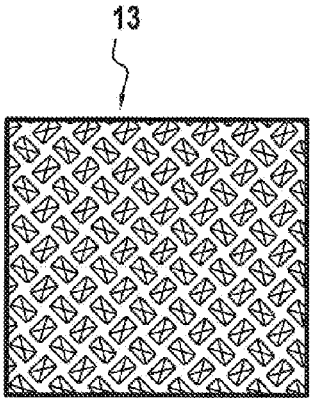
FIGS. 4*a*, 4*b*, and 4*c* show various tread patterns for the surface covering in preferred variants of the present invention.
Figure 4B:
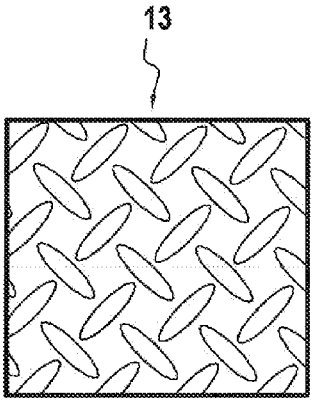
Figure 4C:
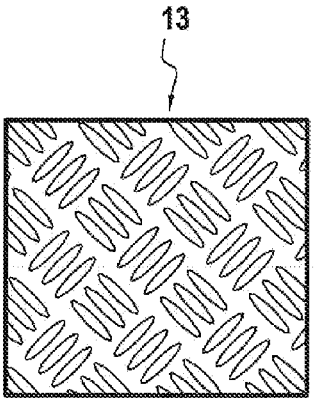

In the embodiment described herein, and as shown in FIGS. 4*a* to 4*c*, the outside face of each of the two layers 11A and 11B has a tread 13 formed directly in the elastomer for the purpose of improving the drivability of the surface covering 100. The tread 13 may take various forms that are shown by way of non-limiting example in FIGS. 4*a* to 4*c*.

As shown in particular in FIG. 1*a* or in FIG. 2*a*, the surface covering 100 has a centering strip 50 that makes it possible to reinforce the stiffness of the covering, and that also makes it possible to see the central axis of the covering, which is advantageous in particular for the driver of the vehicle V who must maintain the sometimes unstable balance of the vehicle by keeping to the middle of the covering.

One of the objectives is to enable the surface covering 100 to be put in place quickly and easily. In addition to the flexibility properties that enable the covering 100 to be deployed quickly, and to the stiffness properties that enable the vehicle V to cross it, in the example described herein, the surface covering 100 has anchor means 30 consisting of a plurality of metal inserts 31 positioned at the periphery of the surface covering 100 so as to enable said covering 100 to be anchored by means of an element such as a metal peg P driven into the surface S.

Thus, as shown in FIG. 3, before the vehicle V crosses the surface, the operator deploys the covering 100 (that is previously rolled up), and attaches the covering 100 to the ground S by inserting the metal pegs P into the various inserts 31 and by driving them into the ground S. This makes it possible to stabilize the covering 100 relative to ground S that is often soft.

In the example described herein, in order to improve deploying, transporting, and taking hold of the covering 100, the surface covering 100 of the present invention has graspable means 40 such as handles.

The solution offered by the present invention makes it possible to have a surface covering of a novel type, such a covering being easy to handle, simple to deploy, lightweight, and compact.

It should be observed that this detailed description relates to a particular embodiment of the present invention, but that under no circumstances is this description in any way limiting on the invention; on the contrary, the aim of this description is to remove any imprecision from the following claims or any occasion for misinterpretation thereof.

In particular, in a variant of the invention, a surface covering is designed in which the covered faces are covered with layers made of different materials, in which the stiffener bars have different properties and dimensions, and in which the distances between the tubular pockets are not identical over the entire covering.

What is claimed is:

1. A rollable surface covering configured to enable a surface to be crossed by a vehicle, comprising:

a double-ply textile core consisting of a first ply and a second ply, the first ply comprising a first face coated a first polymer layer;

the second ply comprising a second face coated with a second polymer layer;

at least one vulcanized-polymer tubular pocket integrally formed from vulcanized polymer of the first polymer layer and the second polymer layer, and extending substantially transversely through the thickness of the core between the first face and the second face;

at least one stiffener bar configured to increase a load-bearing capacity of the surface when the rollable surface covering is unrolled, wherein the at least one stiffener bar is received in the vulcanized-polymer tubular pocket.

2. The rollable surface covering according to claim 1, wherein each ply of the first and second ply is covered on its respective two faces with at least one polymer layer.

3. The rollable surface covering according to claim 2, wherein the at least one polymer layer on an outside face of at least one of the first ply and the second ply has a tread formed directly therein, the tread being configured to improve the drivability of the surface covering.

4. The rollable surface covering according to claim 1, wherein the polymer is an elastomer.

5. The rollable surface covering according to claim 1, wherein each polymer layer has a thickness in the range of 0.5 mm to 3 mm.

6. The rollable surface covering of claim 5, wherein each polymer layer has a thickness of 1.5 mm.

7. The rollable surface covering according to claim 1, wherein the polymer has Shore A hardness in the range of 25 to 90.

8. The rollable surface covering according to claim 1, wherein the rollable surface covering comprises a plurality of tubular pockets, each successive tubular pockets being spaced apart by a separation distance in the range of 80 mm to 300 mm.

9. The rollable surface covering of claim 7, wherein the polymer has Shore A hardness equal to 80.

10. The rollable surface covering of claim 8, wherein each successive tubular pocket is spaced apart by a separation distance equal to 150 mm.

11. The rollable surface covering according to claim 1, comprising a plurality of through tubular pockets, the tubular pockets being substantially parallel to one another.

12. The rollable surface covering according to claim 1, wherein said at least one stiffener bar consists of a composite material.

13. The rollable surface covering according to claim 1, including at least one anchor configured to enable said surface covering to be anchored.

14. The rollable surface covering according to claim 13, wherein the anchor consists of at least one metal insert positioned at the periphery of the surface covering.

15. The rollable surface covering according to claim 13, wherein the anchor comprises a rigid fastening element driven into the surface.

16. The rollable surface covering according to claim 1, including one or more handles positioned around the periphery of the surface covering.

17. The rollable surface covering according to claim 1, wherein the stiffener bar has a bending modulus lying in the range of 40 GPa to 250 GPa.

18. The rollable surface covering according to claim 17, wherein the stiffener bar has a bending modulus equal to 110 GPa.

19. The rollable surface covering according to claim 1, wherein the double-ply textile core is embedded in the two polymer layers, preferably during vulcanization.

20. The rollable surface covering according to claim 1, wherein the double-ply textile core has tensile strength substantially lying in the range of 300 daN/cm to 2000 daN/cm.

21. A method for using the rollable surface covering according to claim 1 for enabling at least one vehicle of the motor vehicle type to cross a surface, e.g. of the uneven, muddy, marshy, or sandy ground type, the method comprising positioning the surface covering on the surface.

22. A rollable surface covering configured to enable a surface to be crossed by at least a vehicle, comprising:

a double-ply textile core consisting of a first ply and a second ply, the first ply being covered on its two faces with at least one elastomer layer;

the second ply being covered on its two faces with at least one elastomer layer;

at least one vulcanized-elastomer tubular pocket integrally formed from vulcanized elastomer of the elastomer layer on inside faces of the first ply and the second ply, and extending substantially transversely through the thickness of the core between the inside faces of the first ply and the second ply, at least one stiffener bar configured to increase a load-bearing capacity of the surface when the rollable surface covering is unrolled, wherein the at least one stiffener bar is received in the vulcanized-elastomer tubular pocket.

23. A rollable surface covering configured to enable a surface to be crossed by a vehicle, comprising:

a double-ply textile core consisting of a first ply and second ply, the first ply being covered on its two faces with at least one polymer layer;

the second ply being covered on its two faces with at least one polymer layer;

at least one vulcanized-polymer tubular pocket integrally formed from vulcanized polymer of the polymer layer of inside faces of the first ply and the second ply, and extending substantially transversely through the thickness of the core between the inside faces of the first ply and the second ply, at least one stiffener bar configured to increase a load-bearing capacity of the surface when the rollable surface covering is unrolled, wherein the at least one stiffener bar is received in the vulcanized-polymer tubular pocket.

* * * * *